United States Patent [19]

Takahashi

[11] Patent Number: 4,955,400

[45] Date of Patent: Sep. 11, 1990

[54] WIGS

[76] Inventor: Masakatsu Takahashi, 4-6, Narihira-cho, Ashiya-shi, Hyogo-ken, Japan

[21] Appl. No.: 423,733

[22] Filed: Oct. 19, 1989

Related U.S. Application Data

[63] Continuation of Ser. No. 52,599, May 19, 1987, abandoned.

[30] Foreign Application Priority Data

May 19, 1986 [JP] Japan ..... 61-115731

[51] Int. Cl.[5] ..... A41G 5/00

[52] U.S. Cl. ..... 132/56; 132/201; 428/242

[58] Field of Search ..... 132/53, 56, 5, 201; 428/15, 374–400, 242

[56] References Cited

U.S. PATENT DOCUMENTS 3,910,291 10/1975 Kim ..... 132/53
4,302,491 11/1981 Papageorgion ..... 132/56
4,688,584 8/1987 Nilsen ..... 132/56

FOREIGN PATENT DOCUMENTS 2129201 10/1972 France ..... 132/201

*Primary Examiner*—John Weiss
*Attorney, Agent, or Firm*—Koda & Androlia

[57] ABSTRACT

A wig including an artificial scalp portion and artificial hair planted thereon. The scalp portion and hair are both composed of fiber filaments formed of a fine powder of a single type or composite type of inorganic or organic substance with excellent heat releasing characteristics and of synthetic fibers, natural fibers, natural hair or regenerated fibers. The fine powder is mixed in the fibers, or those fibers are coated with the powder, using a synthetic resin adhesive for obtaining the fiber filaments. The inorganic powder may be a metallic powder including copper, titanium oxide, aluminum iron, zirconium or ceramic as the primary component, and organic powder may be a powder having synthetic resins or natural fibers as the primary components. The wigs thus provided are easy to handle and care for as they are able to release heat efficiently even at high temperatures or under poorly aerated conditions utilizing the thermal conductivity of the component material of the artificial scalp portion and the artificial hair of the wig.

8 Claims, No Drawings

WIGS

This is a continuation of application Ser. No. 052,599, filed May 19, 1987 now abandoned.

BACKGROUND OF THE INVENTION

1. Field of the Invention

The present invention relates to wigs including hair wigs and hairpieces, and particularly to wigs having artificial hair.

2. Prior Art

A wig is constructed of artificial hair or natural hair and an artificial scalp portion which is used to fix the wig onto a human head an also into which the hair of the wig is implanted.

Artificial hair has conventionally been made by using a fibrous form of polyester, rayon, cotton, etc.

Usually, the artificial scalp portion is formed, in the case of a hair wig, into a network body by using nylon. In the case of a hairpiece, the scalp portion is formed into the same network structure or is formed by sewing it into a rhombic shape in order to make it stretchable.

Also, recently a wig having a scalp portion which comes in a soft and flexible form using a synthetic resin has been seen on the market, with a design to be fixed to the head using a snap fastener system.

Implantation of the hair to the artificial scalp is usually done manually or using sewing machines. A method of combining these two techniques is also employed.

Today, most of artificial hair is made of various types of synthetic fibers. The reasons for this include ease of manufacture, low cost, readiness in obtaining the desired color of hair, and the desire for less troublesome washing and care for the hair.

The present invention has, as its premise, the intention to employ artificial hair made of synthetic fibers which have the various advantages mentioned above.

However, artificial hair made of synthetic fibers has disadvantages including the hair being excessively glossy and unnatural looking. Also, since all of these types of hair are low in thermal conductivity, when they are used the heat from the head is not easily diffused. As a result, in combination with evaporation of moisture from the skin, stuffiness is caused between the head and the artificial scalp portion of the wig.

In particular, when the hair is groomed by applying hair care products thereto, almost no room is left for aeration between the respective strands of artificial hair. Furthermore, when, for example, the outside temperature rises as it does during the Summer, and in some cases, when one is exposed to direct sunlight, the head becomes very hot. Even in winter, when one exercises in a room with a working heating system or is engaged in a stage rehearsal in the theater, etc., the body temperature goes up to the degree that the head area perspires. Therefore, artificial hair made of synthetic fibers which neglibly release heat cause an abnormal increase in the temperature of the head.

In addition, a further increase in temperature is invited when the soft and flexible filmy scalp portion made of synthetic resin, designed to be fixed by snap fasteners to the head as mentioned above, is used due to the low heat diffusibility, not only in the above mentioned artificial hair made of synthetic fibers, but also in this artificial scalp portion itself.

SUMMARY OF THE INVENTION

The present invention, therefore, intends to solve the aforesaid problems found in the prior art.

The primary object of the present invention is, taking into consideration that the greatest area (surface area) of the artificial hair is in contact with atmospheric air, to provide a wig in which the thermal conductivity of the artificial scalp is improved and also wherein heat is smoothly conducted from the artificial scalp to the artificial hair, making it possible for the wig as a whole to diffuse heat with high efficiency.

The above mentioned object is achieved by constructing the artificial scalp portion and the artificial hair by first forming fiber filaments from a fine powder of a single type on a composite type of inorganic or organic material having excellent heat releasing characteristics, and synthetic fibers, natural fibers, natural hair or regenerated fibers, and by assembling these fiber filaments into the artificial scalp and hair of the wig.

The above mentioned artificial scalp may be made by knitting the fiber filaments mentioned above into a network or filmy body. The artificial hair may be made of a single type of fibers with a specified diameter, or may be made by braiding (interwinding) the fibers so as to obtain a microdiameter similar to the thickness of natural hair.

Consequently, when a wig constructed as described above is worn, first the above mentioned powder with excellent thermal conductivity in the fiber filaments which compose the artificial scalp portion functions to absorb the heat produced by the human head. Then the powder in the artificial hair which is implanted in the artificial scalp portion functions to transfer or conduct the absorbed heat throughout the entire length of each individual artificial hair. As a result, through the artificial scalp portion the heat of the head can be released efficiently from the artificial hair which has a large surface area as a whole. Also, because of the thermal conductivity of the component material in the artificial scalp portion as well as the artificial hair, even when the hair is combined or styled with hair care products etc., and the hair is in a poorly aerated state without spaces left between the hairs, a sufficient heat releasing effect can be obtained.

The effects described above can be obtained by mixing the above mentioned powder into the aforesaid fibers or by coating the fibers with the powder. Accordingly, the foregoing effects can be obtained without spoiling the function of the artificial hair itself wherein synthetic fibers, etc. are used.

DETAILED DESCRIPTION OF THE INVENTION

Hereunder, a description of this invention will be provided with reference to the embodiments.

The wigs in the embodiments are formed as follows. That is, fiber filaments are made by using (a) fine powder of a single type or composite type of inorganic or organic substances having excellent heat releasing characteristics and (b) synthetic fibers, natural fibers, natural hairs or regenerated fibers. Then, the fiber filaments thus obtained are formed into an artificial scalp portion and artificial hair.

To be more specific, the fibrous material is constructed from a single type or composite type of metallic powder with excellent heat diffusing characteristics and the synthetic fibers, then, the thus obtained fibrous material is formed into the artificial scalp portion and the artificial hair to compose the wig by combining them.

First, as the synthetic fibers constituting the base material, polyamide system nylon fibrous material which has outstanding durability against outdoor sunlight and is satisfactorily easy to wash is employed. In addition, the following synthetic fibers are used.

1. Polyvinyl system synthetic fibers. For example, polyvinyl chloride system synthetic fibers are preferable as the material for the artificial hair, since they are high in effect of electric insulation, besides the effects due to the basic properties they have as synthetic fibers.

2. Polyester system synthetic fibers. These fibers are suitable for artificial hair because they have the property of quickly drying, making it easy to handle after washing.

3. Polyethylene system and polypropylene system synthetic fibers. These fibers are primarily used for making robes and handicraft yarns. Thus, it is easy, in terms of manufacture, to use them for artificial hair.

4. Polyurethane system synthetic fibers. These fibers are characteristic in that they are high in elasticity. Consequently, they are desirable as the component material of the artificial scalp portion for protecting the human head.

Next, as a single type or a composite type of metallic powder with superior heat releasing characteristics, titanium oxide is employed in the embodiment. The reason for this is that titanium oxide has a delustering effect and makes desirable filaments (dry yarn) as artificial hair and that it is readily colored into preferred tones of color. In addition thereto, the following metallic powders may also be used.

1. Iron. This is high in thermal conductivity, and it can be obtained at a low cost. Therefore, it provides advantages in light of manufacture.

2. Copper. This has remarkably high thermal conductivity. Thus, it is the most desirable in view of the implementation of improvement in heat diffusing effect.

3. Aluminum. This is also a highly heat conductive material. Besides, it is low in specific gravity. Accordingly, when it is used as a component material for a wig to be worn on the head, it is advantageous in that it makes the wig light weight.

4. Zinc, zirconium, etc. may also be used.

Mixing the foregoing titanium oxide powder into nylon fibers can be done by taking the following steps. That is, into a material in the state of molten polymers obtained by polymerization carried out in nitrogen gas ambience, the powder of titanium oxide mentioned above is added and mixed. By cooling and solidifying the mixture in the air after extruding it from the spinneret (nozzle), it is washed with water, then dried, and formed into a fibrous shape (melt spinning process).

In this case, the powder of titanium oxide is mixed at the appropriate ratio of the range for securing the degree of viscosity which keeps the fluidity necessary for the above mentioned melt spinning process.

By mixing titanium oxide, delustering of the artificial hair can be achieved. Also, for tinting the hair to a desired color, the use of this titanium oxide makes the work convenient because it is colored readily.

Next, a description will be given of the case in which the aforesaid fiber filaments are obtained through coating the surface of the previously mentioned synthetic fibers, after manufacturing them, with the above mentioned metallic powder, using synthetic resin adhesive.

As the synthetic resin adhesive for the coating mentioned above, any one selected optionally from thermoplastic adhesives, thermosetting adhesives, and rubber system adhesives may be used.

Therefore, the coating can be done by coating the surface of the foregoing synthetic fibers with the resin, then by adhering the fine powder of titanium oxide which has been tinted to the desired color onto the synthetic fibers coated with resin.

Also as to the combination of the other single type or composite type of metallic powders with the other synthetic fibers described above, the above mentioned processes can be applied to obtain the fibrous materials.

As described above, in the wigs according to this invention, the highly heat conductive powder in the fiber filaments composing the artificial scalp portion absorbs the heat of the human head, and the powder in the artificial hair implanted into the artificial scalp portion carries this heat through the entire length of each respective strand of the artificial hair. As a result, the heat can be released with high efficiency from the entire body of the artificial hair which occupies a larger surface area as a whole. Consequently, even for a person whose work requires a lot of physical movement, and even in places with high air temperature and poor ventilation, heat generated as well as perspiration from the head area can be blocked beforehand. Thus, the wig of this invention is very easy to use.

Furthermore, as the thermal conductivity is utilized, even when the artificial hair is dressed with hair care cosmetics, and in a poor aeration state without having spaces among the respective strands of hair, sufficient heat releasing effect can be obtained. Accordingly, there is no reason for the wearer to be concerning about using hair care cosmetics, etc., and it is easy to maintain and style the wig.

I claim:

1. A wig characterized in that said wig is constructed by forming fiber filaments by coating fibers selected from the group consisting of synthetic fibers, natural fibers, natural hair and regenerated fibers with a powder of inorganic substance with excellent heat releasing characteristics during the manufacturing process of said fibers and then composing said fiber filaments into an artificial scalp portion and artificial hair as components of said wig.

2. A wig according to claim 1 wherein said powder of inorganic substance is metallic powder containing copper as a primary component.

3. A wig according to claim 1, wherein said powder of inorganic substance is metallic powder containing titanium oxide as a primary component.

4. A wig according to claim 1, wherein said powder of inorganic substance is metallic powder containing aluminum as a primary component.

5. A wig according to claim 1, wherein said powder of inorganic substance is metallic powder containing iron as a primary component.

6. A wig according to claim 1, wherein said powder of inorganic substance is metallic powder containing zirconium as a primary component.

7. A wig according to claim 1 wherein said powder of inorganic substance is metallic powder containing ceramic as a primary component.

8. A wig characterized in that said wig is constructed by forming fiber filaments by coating the surfaces of fibers selected from the group consisting of synthetic fibers, natural fibers, natural hair and regenerated fibers with a powder of inorganic substance with excellent heat releasing characteristics by using synthetic resin adhesive after the manufacturing process of said fibers and then composing said fiber filaments into an artificial scalp portion and artificial hair as components of said wig.

* * * * *

UNITED STATES PATENT AND TRADEMARK OFFICE

CERTIFICATE OF CORRECTION

PATENT NO. : 4,955,400

DATED : September 11, 1990

INVENTOR(S) : MASAKATSU TAKAHASHI

It is certified that error appears in the above-identified patent and that said Letters Patent is hereby corrected as shown below:

On the title page:

Under [30] Foreign Application Priority Data: Add --May 2, 1987 (JP) Japan.....62-109384--

Signed and Sealed this

Twenty-first Day of April, 1992

*Attest:*

HARRY F. MANBECK, JR.

*Attesting Officer*

*Commissioner of Patents and Trademarks*